United States Patent [19]

Bettge et al.

[11] Patent Number: 4,737,605

[45] Date of Patent: Apr. 12, 1988

[54] VACUUM SWITCHING TUBE

[75] Inventors: Hans Bettge; Burkhard Mick, both of Berlin, Fed. Rep. of Germany

[73] Assignee: Siemens Aktiengesellschaft, Berlin and Munich, Fed. Rep. of Germany

[21] Appl. No.: 934,337

[22] Filed: Nov. 24, 1986

[30] Foreign Application Priority Data

Dec. 3, 1985 [DE] Fed. Rep. of Germany ..... 3542742

[51] Int. Cl.[4] ..... H01H 33/66

[52] U.S. Cl. ..... 200/144 B

[58] Field of Search ..... 200/144 B

[56] References Cited

U.S. PATENT DOCUMENTS 3,190,991 6/1965 Jennings ..... 200/144 B
4,115,672 9/1978 Lipperts ..... 200/144 B
4,246,458 1/1981 Yanabu et al. ..... 200/144 B
4,478,347 10/1984 Cherry et al. ..... 200/144 B
4,574,169 3/1986 Santilli ..... 200/144 B
4,629,839 12/1986 Falkingham ..... 200/144 B

*Primary Examiner*—Robert S. Macon
*Attorney, Agent, or Firm*—Hill, Van Santen, Steadman & Simpson

[57] ABSTRACT

A vacuum switching tube includes a pair of switch contacts having a larger diameter than their appertaining contact pins, an axial magnetic field being generated in the region of the switch contacts by a shield having high electrical conductivity. The shield is subdivided in an axial direction, is not connected electrically to any of the switch contacts, and is arranged potential-free. The present vacuum switching tube is suited for vacuum switching in a high short circuit breaking capacity.

24 Claims, 2 Drawing Sheets

VACUUM SWITCHING TUBE

BACKGROUND OF THE INVENTION

1. Field of the Invention

The present invention relates to a vacuum switching tube having coaxial contacts with a shield therearound for generating an axial magnetic field.

2. Description of the Prior Art

A vacuum switching tube is disclosed in German Patent OS No. 24 42 936 and corresponding U.S. Pat. No. 3,899,079 wherein it is proposed to generate an axial magnetic field from an ion current present at the discharge space between the two electrodes. A screen lying at the potential of one of the two electrodes is used for the generation of the axial magnetic field. In practice, the ion current amounts to about 10% of the overall current.

Since the screen in the known vacuum switching tube lies at the potential of one of the two electrodes, an asymmetrical distribution of potential is present. This asymmetrical potential distribution requires a considerably larger space between the non-contacted cooperating electrode and the screen than that for potential-free arrangements of shielding which are found in switching tubes without axial magnetic fields.

In the literature is known numerous executions of switch contacts in a switching tube containing means for generating an axial magnetic field. These contacts must generate the full required magnetic field and, therefore, are heavier than simple switch contacts, on the one hand, and, on the other hand, require additional space due to the means for generating the axial magnetic field. Based on the design of the contacts, this space can be required in the axial direction and/or in the radial direction. A considerable enlargement and a resulting increase in price of the switching tubes is caused in both instances. Furthermore, an added expenditure for the drive energy in the vacuum switch and an undesirable rise in the resistance of the internal contacts and, thus, the overall tube resistance due to the coil-like current paths required for generating the axial magnetic field derives. The increased resistance, in turn, increases the dissipated power at nominal current when the contacts are in the engaged position.

SUMMARY OF THE PRESENT INVENTION

An object of the present invention is to generate an axial magnetic field in the region of the switch contacts in a vacuum switching tube while keeping the vacuum tube small relative to its circuit making and breaking capacity.

Another object of the present invention is to provide a vacuum switching tube with a small movable switch contact mass and a lower internal resistance as compared to switching tubes without axial field contact.

These and other objects and advantages of the present invention are achieved in a vacuum switching tube having a shield extending around the switch contacts and electrically isolated therefrom, the shield being spaced sufficiently from the contacts to prevent arcovers.

The invention is based on the perception that a switch contact that has a greater diameter than its appertaining terminal pin generates eddy currents in the surrounding shield. For an appropriately shaped shield, the eddy currents produce an axial magnetic field which is sufficient to diffuse arcs occurring during switching events, particularly of high currents.

The shield, or screen, is slotted, and for efficiency considerations, is arranged potential-free. In other words, the shield is free of connections to a predetermined potential. As a result thereof, the shield may be mounted relatively close to the switch contacts and, in one development, is spaced one and a half times the open contact spacing from the respective contacts. Such spacing guarantees that the axial magnetic field has a strong effect on any turn-off arcs and, further, that the structural format of the vacuum tube does not differ substantially from the standard format of vacuum tubes not having axial magnetic fields. The present vacuum switch is, thus, well suited for high short-circuit breaking capacity.

Like vacuum tubes not having axial magnetic fields, the switch contacts of the present device have a low mass with low internal tube resistances so that little power is dissipated at nominal voltage loads when the switch contacts are in their closed condition. This advantage in the construction of the switching tube having an axial magnetic field in the region of the switch contacts is not achieved in the known switch contacts having means for generating an axial magnetic field.

In comparison to the known devices, the screen or shield of the present invention need only have a conductivity sufficient so that eddy currents of a suitable scale can generate an axial magnetic field. In a medium voltage tube of a standard type, it is sufficient for this purpose that the shield be formed of copper and have a thickness of at least two millimeters. The screen need only extend in the axial direction at least twice the contact spacing when the contacts are in their off/open position.

If a greater extent of shielding is desired in an axial direction for shielding reasons, then the shielding can be formed of a relatively thick material having a good electrical conductivity in the region of the discharge space over a length in the axial direction corresponding to twice the contact spacing in the open condition. A thinner, unslotted material having a lower conductivity is provided in the regions axially adjoining the first region, the thinner, unslotted material having a high dielectric strength. One example of such high dielectric strength material for use in the present vacuum switching tube is stainless steel.

The reduced size of the overall vacuum switching tube is possible by the provision of a shield having a helically slotted cylindrical shape. The cylindrical wall of the shield can alternately and advantageously include slots extending perpendicular to the rotational axis of the cylinder. These perpendicular slots are offset relative to one another in an axial direction. Two or more of such slots partially penetrate the cylinder wall and are connected to one another by axially directed slots. As a result of such slots, a helix-like slot structure is formed easily with a pitch adapted to the local magnetic field conditions.

In another development, a relatively simple and stable structure for a shield is provided by two slots formed in the shield in the same axial position and symmetrically positioned relative to the rotational axis of the cylinder wall. A plurality of such slot pairs are arranged following one another in an axial direction and offset in a circumferential direction relative to the next adjacent slot pair. In this embodiment, the cylindrical shield retains a considerable degree of strength. The amount of the mutual offset of the slot pairs topically influence the axial component of the magnetic field.

Yet another embodiment of the present shield or screen is provided by subdividing the shield into individual shield rings in the axial direction. A division of the electrical conductivity in the axial direction is particularly easily achieved by such subdivision. The shield rings at the outside of the shield in an axial direction are manufactured of a material having low conductivity and a high dielectric strength, such as, for example, of stainless steel.

To reliably shield the metal vapor from the insulating wall regions which lie behind the slots, the slots of the present device are shaped to provide limiting surfaces in the radial direction on the surfaces defining the slots. In one development, the limiting surfaces are inclined relative to the rotational axis of the cylinder so that the limiting surfaces at each of the slots overlap in the direction of view of the two outer edges of the switch members which face the discharge gap. Such overlapping of the limiting surfaces is relative to the switch contacts when they are in the opened position. The limiting surfaces of each slot are preferably mutually differently arranged depending on their relative position to the electrodes.

DESCRIPTION OF THE PREFERRED EMBODIMENTS

Figure 1:
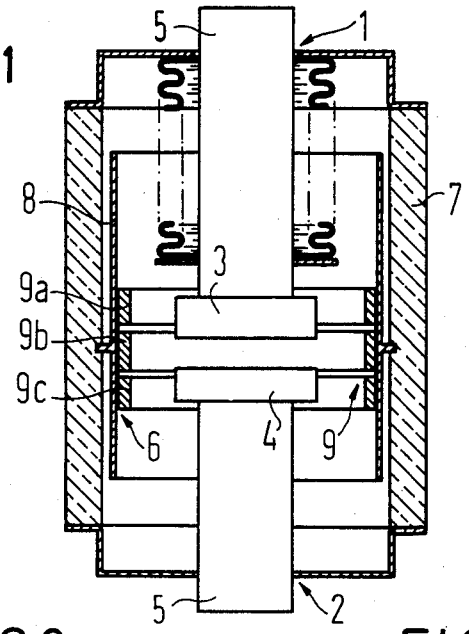
FIG. 1 is a vertical cross section through a vacuum tube according to the principles of the present invention.

A vertical cross section through a vacuum switching tube is shown in FIG. 1, including a movable switch contact 1 and a fixed switch contact 2 lying coaxially opposite one another. Each of the contacts 1 and 2 include respective contact members 3 and 4 affixed to contact pins 5, the contact members 3 and 4 having a larger diameter than that of the contact pins 5. The contact members 3 and 4 are formed, for example, as simple plate contacts having radial slots or, alternately, slots offset parallel to a diameter. The contact members 3 and 4 have contact faces which touch when the contacts are in a closed, or on, condition. The contact faces of the contact members 3 and 4 need not extend up to the edges of the contact members, particularly since arcs forming between the contact members 3 and 4 are forced toward the outside quickly enough.

The contact members 3 and 4 are coaxially disposed within an insulating portion 7 of a vacuum tube housing. A coaxial shield 6 is provided about the contact members 3 and 4 to separate the contact members 3 and 4 from the insulating portion 7. The shield 6 is formed of a thin walled outer cylinder 8 and a thicker walled cylinder 9, the cylinder 9 being shown here subdivided into subcylinders, or shield rings, 9*a*, 9*b*, and 9*c*. The shield cylinder 9 covers both of the contact members 3 and 4 in the radial direction when the contacts 1 and 2 of the vacuum switching tube are in the open position.

When the vacuum switching tube is connected to power, current flowing through the switch contacts 1 and 2 generates eddy currents in the shield cylinder 9. Axial components of the eddy currents are kept small by the subdivision of the shield cylinder 9 into the shield rings 9*a*, 9*b*, and 9*c*. As a result of the relatively large cross section of the shield rings 9*a*, 9*b*, and 9*c*, and as a result of using a metal with good electrical conductivity to form the rings 9*a* through 9*c*, eddy currents arise in a circumferential direction in the shield 9. Such circumferential eddy currents generate a considerable axial magnetic field. The axial magnetic field generated within the vacuum switching tube increases the making and/or breaking capacity of the tube.

It is essential to have a small spacing between the contact members 3 and 4 and the shield 9. A particularly suitable spacing between the contact members 3 and 4 and the shield 9 is about 1.5 times the spacing of the contact member electrodes 3 and 4 when they are in an open condition. Such spacing guarantees, first, protection against arc-overs from the contact members 3 and 4 onto the shield 9 and, second, an adequate influence by the magnetic field as generated by the eddy currents on any discharge arcs between the contact members 3 and 4. For contact diameters of up to about 100 mm, a shield 9 having a wall thickness of about 2 mm is sufficient.

The extent of the shield 9 in an axial direction should, first, be at least twice the spacing of the contacts 3 and 4 when in the open condition and, second, should cover the contact members 3 and 4 in the radial direction when in the open condition.

A relatively thin walled shield cylinder 8 of a material having poor electrical conductivity and preferably having a high dielectric strength is used outside the shield 9 to protect the insulating housing portion 7. The thin walled cylinder 8 offers mechanical stability for the shield rings 9*a*, 9*b*, and 9*c*, but does not itself noticeably contribute to the formation of eddy currents in either an axial or circumferential direction since it is of a material having poor conductivity.

Figure 2:
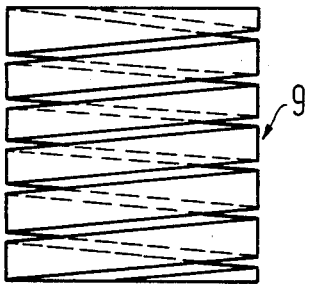
FIG. 2 is a side elevational view of a disembodied shield of the present invention.

In FIG. 2, a shield 9′ is shown in the form of a helically parted cylinder. The shield 9′ is relatively simple to manufacture and also guarantees the necessary mechanical stability without requiring an additional shielding cylinder 8. In this format, eddy currents are formed over part of the shield's circumference, while eddy currents that are in the axially proximate regions flow in one direction and eddy currents that are in the axially distal regions flow in the other direction. This is possible as a consequence of the different spacings from the axis. In the illustrated embodiment, there is an especially great influence by the wall thickness of the slotted cylinder on the eddy currents and on the field strength in the axial direction.

Figure 3:
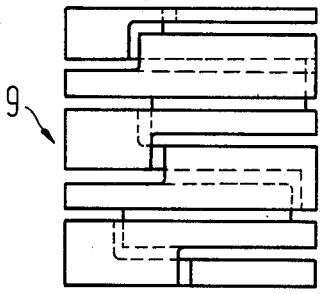
FIG. 3 is a side elevational view of an alternate embodiment of a shield of the present invention.

As shown in FIG. 3, another embodiment of a shield 9″ provides the same advantage and includes a helical separation approximated by parting the cylindrical shield 9″ in steps. The slots are perpendicular to the cylinder axis and are connected at their ends by shorter slots extending axially. This embodiment enables simple programming of automatic manufacturing means and is formed by simply varying the width of the web of which the shield 9″ is formed in an axial direction.

Figure 4:
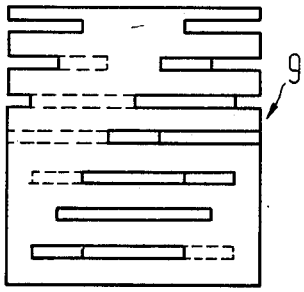
FIG. 4 is a side elevational view of a further embodiment of a shield of the present invention.

In FIG. 4, a shield 9‴ is shown in an especially strong and stable embodiment, in which eddy currents are formed in a circumferential direction while eddy currents in an axial direction are impeded. The shield 9‴ is formed by pairs of opposing slots partially extending about a cylinder at the same axial position and by further pairs of similar partial slots displaced circumferentially and axially with respect to the next adjacent slot pair.

Figure 5:
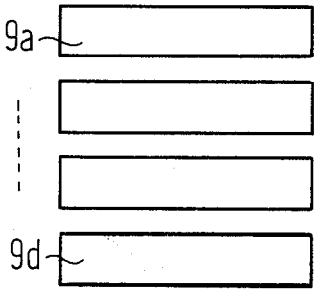
FIG. 5 is a side elevational view of another embodiment of a shield according to the present invention.

Referring now to FIG. 5, a shield 9⁗ is completely separated into individual shield rings 9a⁗ through 9d⁗ similar to the embodiment shown in FIG. 1. The shield rings 9a⁗ through 9d⁗ define slots extending perpendicular the cylinder's axis.

Figure 6:
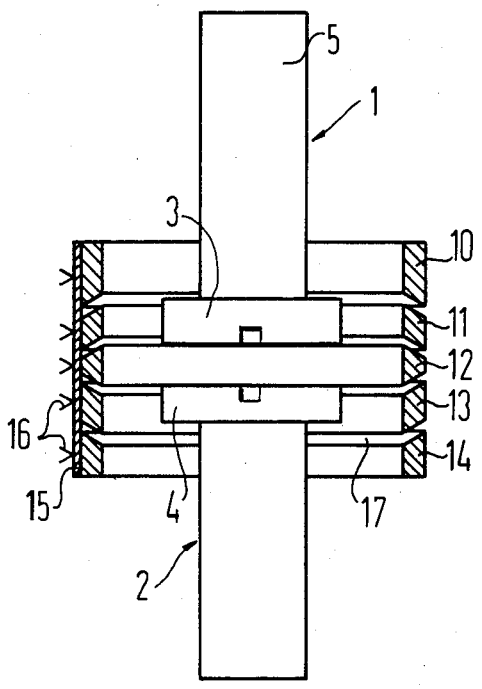
FIG. 6 is a vertical cross section of yet another shield of the present invention shown in relation to a pair of switch contacts of a vacuum switch tube.

As shown in FIG. 6, a development of the present invention includes providing individual shield rings 10, 11, 12, 13, and 14, each with slanted end faces 17 forming limiting surfaces so as to avoid vapor deposition on the insulating portions of the switching tube (not shown in FIGS. 6). The slant of the slanted end faces 17 is different for different ones of the rings 10 through 14. The angle of the slanted end faces 17 changes midway between the contact members 3 and 4 when in the open position. The end faces 17 are slanted in a direction relative to the rotational axis of the switch contacts 1 and 2. As a result of the changed slant angles of the end faces 17, different cross-sectional shapes for the rings 10 through 14 arise, with the middle ring 12 having a trapezoidal cross section. The end faces 17, which form the limiting surfaces, prevent material vaporized by arcing between the contacts 3 and 4 from passing through the slots in the shield and becoming deposited on the inside walls of the vacuum tube. It is also contemplated to use other shapes of end faces between the shield rings to provide limiting surfaces so long as the end faces overlap in a radial direction. The slanted end faces 17, or alternately, other shaped end faces can also be provided on other embodiments of the shield members, particularly where a shielding cylinder 8 is not desired.

Figure 7:
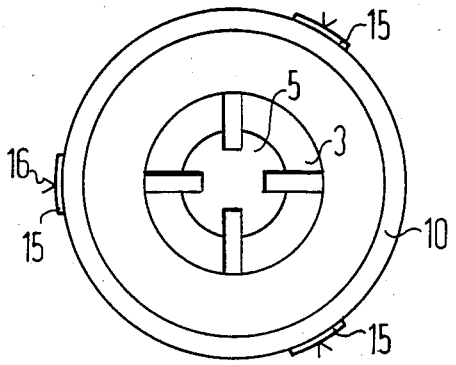
FIG. 7 is a plan view of the shield and contact arrangement shown in FIG. 6.

Insofar as the thin walled shielding cylinder 8 as shown in FIG. 1 is not used, it is recommended to connect the individual rings 10 through 14 of FIGS. 6 and 7 by bands 15 formed of a metal having poor electrical conductivity. The bands 15 provide structural support and are secured, in the illustrated embodiment, by spot welding at welds 16 to the rings 10 through 14. As seen in FIG. 7, three bands 15 suffice to hold the rings 10 through 14 and are preferably equally spaced about the circumference of the rings so that they are offset relative to one another by an angle of approximately 120°. Such support bands may be provided as well on other embodiments of the shields, where desired.

Although other modifications and changes may be suggested by those skilled in the art, it is the intention of the inventors to embody within the patent warranted hereon all changes and modifications as reasonably and properly come within the scope of their contribution to the art.

We claim as our invention:

1. A vacuum switching tube having first and second coaxial switch contacts movable relative to each other between an open and a closed position on an axis and each including a contact pin and a contact member, the open position of the switch contacts causing the contact members to be spaced apart by a first distance being a discharge gap, each of the contact members having a greater diameter than the contact pins, and an electrically insulated housing part disposed about the switch contacts, comprising:

at least shield one for protecting said insulated housing part against metal vapor depositions caused as a result of switching of said contacts, said at least one shield electrically isolated from said first and second contacts to lie at floating potential relating to said contacts, said at least one shield disposed spaced from both said first and second contacts by an insulating space to prevent arc-overs and formed of a good electrically conductive material, said shield having an axial extent greater than said first distance and overlapping said contact members in the radial direction relative to the axis; and the contact members defining slots formed therein, wherein said shield is a helically slotted hollow cylinder.

2. A vacuum switching tube as claimed in claim 1, wherein said slots extend radially across a contact face of each of the contact members.

3. A vacuum switching tube as claimed in claim 1, wherein said slots extend parallel to a diameter of the contact members and across a contact face of each of the contact members.

4. A vacuum switching tube as claimed in claim 1, wherein said shield is disposed spaced from the edge of the contact members by about 1.5 times the first distance between the first and second contact members when the contact members are in an open condition.

5. A vacuum switching tube as claimed in claim 1, wherein said shield is formed of copper and is at least 2 mm thick.

6. A vacuum switching tube as claimed in claim 1, wherein said shield has an axial extent at least twice the maximum spacing of the contact members when in the open position.

7. A vacuum switching tube as claimed in claim 1, wherein said slots have limiting surfaces relative to a radial direction, said limiting surfaces being inclined relative to the rotational axis of said cylinder and said limiting surfaces of at least one slot overlapping in the direction of view from the outside edges of each of said switch members adjacent the discharge gap when said switch members are in the open position.

8. A vacuum switching tube as claimed in claim 7, wherein said limiting surfaces of said slots are differently inclined depending on their relative position to a plane normal to the axis and midway of said discharge gap.

9. A vacuum switching tube having first and second coaxial switch contacts movable relative to each other between an open and a closed position on an axis and each including a contact pin and a contact member, the open position of the switch contacts causing the contact members to be spaced apart by a first distance being a discharge gap, each of the contact members having a greater diameter than the contact pins, and an electrically insulating housing part disposed about the switch contacts, comprising:

at least one shield for protecting said insulated housing part against metal vapor depositions caused as a result of switching of said contacts, said at least one shield electrically isolated from said first and second contacts to lie at floating potential relative to said contacts, said at least one shield disposed spaced from both said first and second contacts by an insulating space to prevent arc-overs and formed of a good electrically conductive material, said shield having an axial extent greater than said first distance and overlapping said contact members in the radial direction relative to the axis; and the contact members defining slots formed therein, wherein said shield is a hollow cylinder having slots extending perpendicular to the rotational axis of said hollow cylinder.

10. A vacuum switching tube as claimed in claim 9, wherein said slots are offset in an axial direction relative to one another, two or more of said slots only partially penetrating the wall of said cylinder, and said slots being connected to one another at their respective end points by axially directed slots.

11. A vacuum switching tube as claimed in claim 9, wherein a pair of said slots extend in the same axial position and circumferentially symmetrical relative to the rotational axis of said cylinder, and wherein a plurality of other pairs of said slots are disposed offset in an axial direction and offset in a circumferential direction relative to a next adjoining pair of said slots.

12. A vacuum switching tube as claimed in claim 9, wherein said slots include limiting surfaces in a radial direction, said limiting surfaces being inclined relative to the rotational axis of said cylinder, and said limiting surfaces of at least one slot overlapping in the direction of view from each of the outside edges of each of said switch members adjacent the discharge gap when said switch members are in the open condition.

13. A vacuum switching tube as claimed in claim 12, wherein said limiting surfaces of said slots are differently inclined depending on their position relative to a plane normal to the axis and midway of said discharge gap.

14. A vacuum switching tube as claimed in claim 9, wherein said slots extend radially across a contact face of each of the contact members.

15. A vacuum switching tube as claimed in claim 9, wherein said slots extend parallel to a diameter of the contact members and across a contact face of each of the contact members.

16. A vacuum switching tube as claimed in claim 9, wherein said shield is disposed spaced from the edge of the contact members by about 1.5 times the first distance between the first and second contact members when the contact members are in an open condition.

17. A vacuum switching tube as claimed in claim 9, wherein said shield is formed of copper and is at least 2 mm thick.

18. A vacuum switching tube as claimed in claim 9, wherein said shield has an axial extent at least twice the maximum spacing of the contact members when in the open position.

19. A vacuum switch tube having first and second coaxial switch contacts movable relative to each other between an open and a closed position on an axis and each including a contact pin and a contact member, the position of the switch contacts causing the contact members to be spaced apart by a first distance being a discharge gap, each of the contact members having a greater diameter than the contact pins, and an electrically insulated housing part disposed about the switch contacts, comprising:

at least one shield for protecting said insulated housing part against metal vapor depositions caused as a result of switching of said contacts, said at least one shield electrically isolated from said first and second contacts to lie at floating potential relative to said contacts, said at least one shield disposed spaced from both said first and second contacts by an insulating space to prevent arc-overs and formed of a good electrically conductive material, said shield having an axial extent greater than said first distance and overlapping said contact members in the radial direction relative to the axis; and the contact members defining slots formed therein, wherein said shield is subdivided into individual shield rings in an axial direction.

20. A vaccum switching tube as claimed in claim 19, wherein said slots extend radially across a contact face of each of the contact members.

21. A vacuum switching tube as claimed in claim 19, wherein said slots extend parallel to a diameter of the contact members and across a contact face of each of the contact members.

22. A vacuum switching tube as claimed in claim 19, wherein said shield is disposed spaced from the edge of the contact members by about 1.5 times the first distance between the first and second contact members when the contact members are in an open condition.

23. A vacuum switching tube as claimed in claim 19, wherein said shield is formed of copper and is at least 2 mm thick.

24. A vacuum switching tube as claimed in claim 19, wherein said shield has an axial extent at least twice the maximum spacing of the contact members when in the open position.

* * * * *